United States Patent [19]

Hay, II et al.

[11] 4,423,767

[45] Jan. 3, 1984

[54] FLAT PLATE HEAT EXCHANGE APPARATUS

[75] Inventors: Robert A. Hay, II, Midland; Charles C. Crugher, III, Beaverton, both of Mich.

[73] Assignee: The Dow Chemical Company, Midland, Mich.

[21] Appl. No.: 465,726

[22] Filed: Feb. 11, 1983

[51] Int. Cl.[3] ..... F28F 9/22; F28D 1/00

[52] U.S. Cl. ..... 165/81; 165/140; 165/145; 165/159; 165/166; 422/138

[58] Field of Search ..... 165/81, 140, 141, 145, 165/159, 166, 167; 422/138; 526/73

[56] References Cited

U.S. PATENT DOCUMENTS

| | | | |
|---|---|---|---|
| 1,961,533 | 6/1934 | Stancliffe | 165/159 |
| 3,014,702 | 12/1961 | Oldershaw et al. | 165/159 |
| 3,280,899 | 10/1966 | Brasie | 165/109 R |
| 3,424,240 | 1/1969 | Stein et al. | 165/166 |
| 3,884,297 | 5/1975 | Fegraus et al. | 165/145 |

*Primary Examiner*—Sheldon J. Richter

*Attorney, Agent, or Firm*—R. B. Ingraham

[57] ABSTRACT

A heat exchange assembly is provided which employs concentric flat plate heaters, the heat exchange assembly having a common fixed tube sheet and floating tube sheet; the floating tube sheet comprising two concentric portions having frustoconical interface thereby, the frustoconical interface when projected has its apex in a plane containing the adjacent face of the fixed tube sheet in the axis of generation of the flat plate heater. Thermal stress on the floating tube sheet is thereby relieved. The heat exchanger is useful as a reactor particularly where the temperature profile of the material flowing therethrough is controlled or varied.

4 Claims, 4 Drawing Figures

FLAT PLATE HEAT EXCHANGE APPARATUS

This invention relates to a flat plate heat exchange apparatus particularly suited for the handling of viscous liquids.

Oftentimes in the processing of viscous liquids, heat exchange becomes difficult and therefore temperature control becomes difficult. In the processing of certain viscous liquids, for example, a polymer syrup, lack of adequate temperature control can lead to undesirable products. For example, in free radical polymerizations, loss or lack of adequate temperature control can result in products of undesirable molecular weight and hence undesirable physical properties. In isothermal reactions, lack of adequate temperature control may lead to undesired crosslinking and where a thermoplastic product is desired, undesirable crosslinked gels may appear. In some cases, excessive temperature may cause depolymerization coupled with degradation of the molecular weight.

A wide variety of reactors have been developed for handling of viscous liquids. For example, Crawford in U.S. Pat. No. 3,513,145, issued May 19, 1970, discloses an auger type reactor suitable for the continuous mass polymerization process. Another auger type reactor is disclosed by Kii et al. in U.S. Pat. No. 3,679,651 filed Aug. 29, 1962. The heat exchanger of the flat plate variety which was developed for the processing of viscous liquids was disclosed by Oldershaw et al. in U.S. Pat. No. 3,014,702 filed Dec. 1, 1958. A non-short-circuiting flat plate heat exchanger reactor suitable for the handling of viscous liquids is disclosed by Brasie in U.S. Pat. No. 3,280,899, filed Mar. 22, 1965. U.S. patent application Ser. No. 392,397, filed June 25, 1982, discloses an improved heat exchange vessel employing concentric heat exchangers having a common fixed tube sheet and a common floating tube sheet. Spiral grooves or slits in the floating tube sheet serve to reduce thermal stress introduced by temperature differential between the adjacent concentric flat plate heat exchangers.

It would be desirable if there were available an improved heat exchange vessel suitable for reactions involving viscous liquids wherein the floating tube sheet is subjected to reduced thermal stress.

It would also be desirable if there were an improved reactor suitable for the processing of viscous polymer syrups wherein the floating tube sheet is generally stress free when adjacent flat plate heaters are operating at different temperatures.

It would also be desirable if there were available an improved heat exchange apparatus which permitted control of temperature in at least two zones thereof wherein the tubes of the flat plate heat exchangers are subjected to minimal stress when an inner exchanger is operated at a higher temperature than an outer heat exchanger.

These benefits and other advantages in accordance with the present invention are achieved in a heat exchange vessel, the vessel comprising an axis extending from a first end to a second end, a foraminous feed tube disposed generally coaxially with the axis of the vessel at least adjacent the first end, a first annular flat plate heat exchanger disposed coaxially about the foraminous tube; at least a second flat plate heat exchanger disposed externally to the first flat plate heat exchanger and generally coaxial therewith; means to supply a first heat exchange fluid to the first flat plate heat exchanger; means to supply a second heat exchange fluid to the second flat plate heat exchanger, the first and second flat plate heat exchangers being disposed within the vessel, the vessel having a product discharge port at the second end of the vessel with the further limitation that each of the flat plate heat exchangers comprise a plurality of generally annular flat plates, each having a centrally disposed aperture; the flat plate-like member assembled perpendicularly to the axis of the vessel with a space between each of the individual plate members; the plate members being positioned in close proximity to one another to provide a flow pattern between adjacent members, the plate members being in spaced apart relationship; a plurality of heat exchange conduits passing through said plate-like members to thereby permit circulation of heat exchange fluid through said conduits, wherein each of the flat plate heat exchangers has a common fixed tube sheet and a common floating tube sheet supported primarily by tubes passing through the flat plate heat exchanger, the improvement which comprises providing a floating tube sheet, the floating tube sheet comprising a first generally annular outer portion, a second generally discoidal inner portion, a frustoconical interface between the first and second floating tube sheet portions, the frustoconical interface being projectible to a cone having an apex which lies approximately at the intersection of a face of the fixed tube sheet which is adjacent a floating tube sheet and the intersection of said plane with the axis of generation of the flat plate heat exchangers.

Further features and advantages of the present invention will become more apparent from the following specification taken in connection with the drawing wherein.

Figure 1:
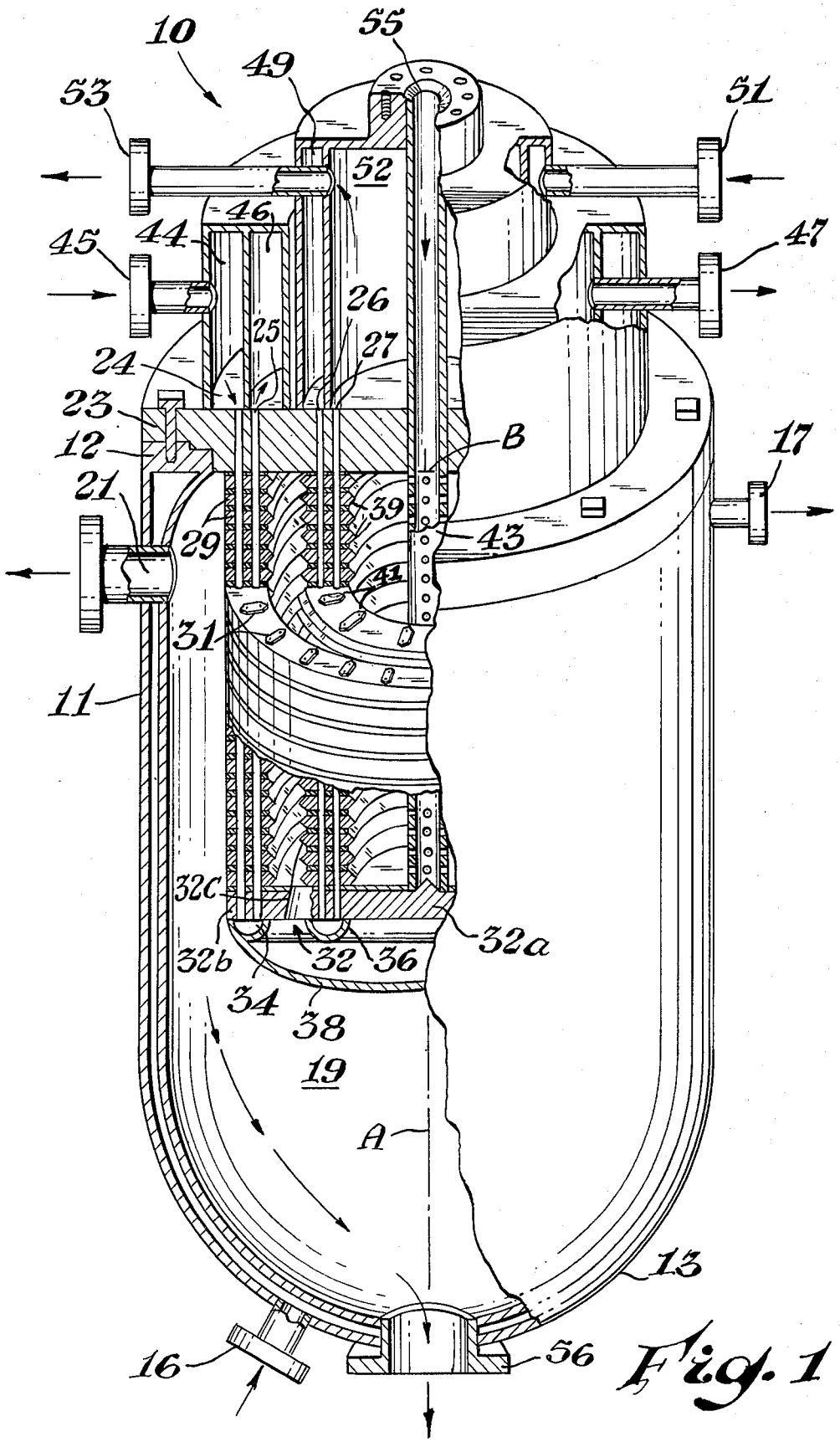
FIG. 1 is a partly in-section view of a heat exchange apparatus in accordance with the present invention.

In FIG. 1 there is schematically depicted a partly in-section view of a heat exchanger in accordance with the present invention generally designated by the reference numeral 10. The heat exchanger 10 comprises a double walled shell or jacketed vessel 11. The shell 11 has an upper or first end 12 and a lower or second end 13. Adjacent the lower end 13 is a jacketed heat transfer medium inlet 16. A jacket heat transfer medium outlet 17 is disposed adjacent the upper or first end 12 of the double walled shell 11. Within the double walled shell 11 is defined a heat exchanger space 19. A volatile discharge port 21 provides communication between the space 19 and space external to the double walled shell 11. A first or fixed common tube sheet 23 is disposed in sealing relationship with the upper end 12 of the double walled shell 11. The tube sheet 23 has passing therethrough a first plurality of heat exchange fluid tubes 24, and a second plurality of heat exchange fluid tubes 25 is inwardly radially disposed from the tubes 24 toward the axis "A" of the double walled shell 11. A third plurality of heat exchange fluid tubes 26 are generally inwardly radially disposed from tubes 25 toward the axis A. A fourth plurality of heat exchange fluid tubes 27 is radially inwardly disposed from the plurality of tubes 26. The plurality of tubes 24 and 25 passes through a plurality of axially stacked annular plate members 29, each of the members 29 has an inner edge chamfered to about a 90° angle, each of the plates 29 being separated from adjacent plates 29 by means of a plurality of spacers 31.

The plurality of tubes 24 and 25 terminate in a bottom or floating tube sheet 32 and into an annular plenum 34. The plurality of tubes 26 and 27 similarly terminate at the floating tube sheet 32 in a generally annular plenum 36. The bottom or floating tube sheet 32 comprises a first generally circular portion 32*a* and a surrounding annular portion 32*b*. The tubes 26 and 27 engage the tube sheet portion 32*a* whereas tubes 24 and 25 engage the tube sheet portion 32*b*. Between the tube sheet portions 32*a* and 32*b* is an interface 32*c* which has a generally frustoconical configuration. Theoretically assuming the heat exchanger is made of materials having the same coefficient of thermal expansion, projection of the interface 32*c* would provide a cone having its apex at point B. Point B is the location of the intersection of the plane of a face of the fixed head 23 which is generally adjacent the floating tube sheet 32 and the axis of generation A of the flat plate heat exchanger 10. The third and fourth series of tubes 26 and 27 have disposed thereon and axially stacked generally similar annular plates 39 which are generally coaxially disposed and enclosed by the annular plates 29. Each of the plates 39 having inner and outer edges are chamfered to about 90°. The plates 39 are separated from adjacent plates 29 by spacers 41. Generally coaxially disposed with the axis A of the double walled shell 11 is a foraminous feed tube 43. The feed tube 43 is affixed to the lower tube sheet 32. Affixed to the tube sheet 23 is a first annular plenum 44 having a heat exchange inlet conduit 45. The plenum 44 communicates with the first plurality of tubes 24. A second annular plenum 46 surrounded by plenum 44 is in communication with the second plurality of tubes 25 and with a heat transfer medium outlet 47. A third annular plenum 49 surrounded by plenum 46 is in communication with a third plurality of tubes 26. The plenum 49 has in communication therewith a heat transfer medium inlet 51. Disposed within and surrounded by the plenum 49 is a fourth plenum 52, which is in communication with the plurality of tubes 27 and a heat transfer medium outlet conduit 53. The foraminous tube 43 terminates at the tube sheet 32 generally adjacent the second end 13 of the shell 11 and at a material inlet 55 generally adjacent the first or upper end 12 of the vessel 11.

In operation of the apparatus of FIG. 1, material to be treated is fed into the inlet 55, passes through the foraminous tube 43 and passes to a space between the plates 39 and the tube 43. The material passes between the plates 39 into a space between the plates 29, and subsequently through the spaces between the plates 29 downwardly toward the second end 13 of the vessel 11 and out through a discharge port 56. Heat exchange fluids at the appropriate temperatures are supplied to the jacket 16, to the inlet 45 and 51, to maintain the jacket and what may be termed the inner and outer flat plate heaters at a desired temperature for the process employed. Volatile material if desired may be removed through 21.

Figure 2:
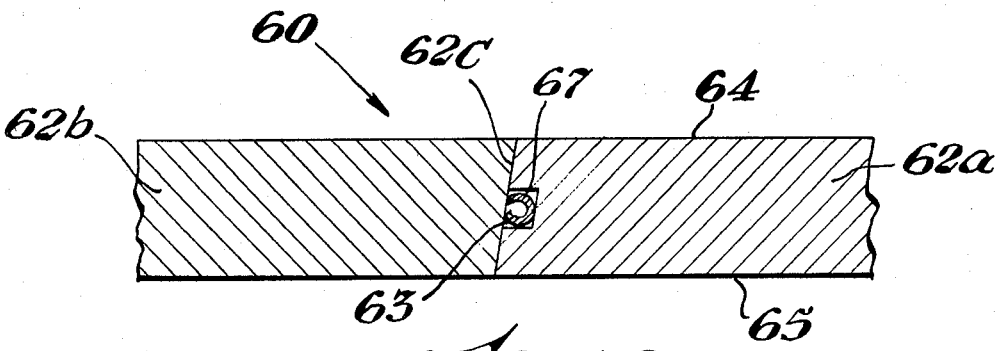
FIGS. 2, 3 and 4 are fractional views of tube sheets suitable for the present invention.

In FIG. 2, there is schematically represented a fractional sectional view of a floating tube sheet 60 suitable for use in the practice of the present invention. The floating tube sheet 60 is a first generally circular configuration designated by the reference numeral 62*a* and a second generally annular portion 62*b*. The floating tube sheet 60 defines a generally annular frustoconical interface 62*c* disposed between the floating tube sheet portions 62*a* and 62*b*. Tube sheet portion 62*a* defines a generally rectangular outwardly facing annular recess 63 disposed at the interface 62*c* and generally intermediate between tube sheet faces 64 and 65. Disposed within the annular groove 63 is a C ring 67 which provides a liquid tight seal between tube sheet portions 62*a* and 62*b*. Beneficially, the C ring 67 is of a synthetic resinous material such as polytetrafluoroethylene or alternatively may be metal or other suitable composition depending upon the particular end use intended for a vessel generally in accordance with the present invention.

Figure 3:
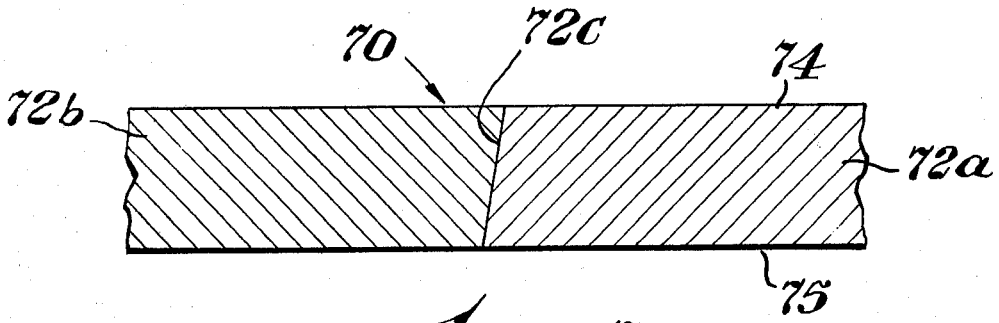

In FIG. 3, there is schematically depicted a fractional sectional view of a portion of a floating tube sheet generally designated by the reference numeral 70. The tube sheet 70 comprises an inner circular portion 72*a* and an external generally annular portion 72*b*. Disposed therebetween portion 72*a* and 72*b* is a sliding interface 72*c* generally similar to the interfaces 62*c* and 32*c* of FIG. 3 and FIG. 1 respectively. Beneficially the interface 72*c* provides a fit sufficiently close that material either does not flow from a tube surface 74 toward a surface 75 of tube sheet 70, or the flow rate is sufficiently low that any loss of material therethrough is not significant to the process in question. Advantageously a close fitting interface such as the interface 72*c* may be obtained by lapping the portions 72*a* and 72*b* together and then the desired fit is achieved.

Figure 4:
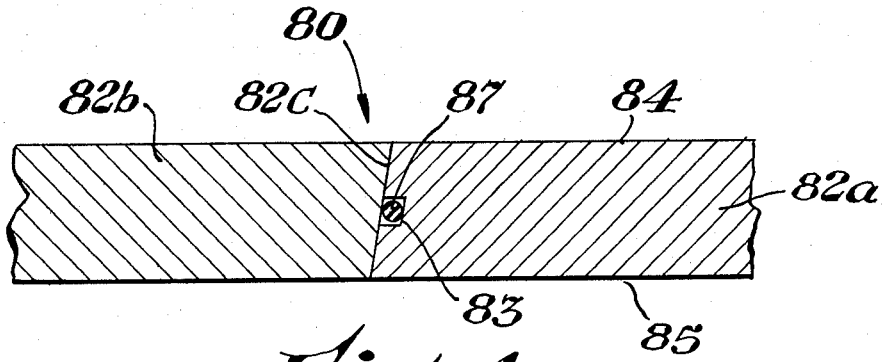

In FIG. 4, there is schematically depicted a floating fractional sectional view of a tube sheet 80 having a first or circular portion 82*a* and a second generally annular portion 82*b*. The portions 82*a* and 82*b* define a generally frustoconical interface 82*c* disposed therebetween. A generally annular outwardly facing groove 83 is defined by tube sheet portion 82*a* and has disposed therein a flexibel O ring 87. The O ring 87 provides a seal which prevents the flow of materials between face 84 of the tube sheet 80 and the opposed face 85 of the tube sheet 80.

Reactors in accordance with the present invention, particularly those depicted in FIGS. 1 and 3, are suited primarily for operation wherein high viscosity liquids are employed. When the frustoconical surfaces such as the surfaces 32*c* and 72*c* are projected to an apex which lies approximately at point B, the seal between the floating tube sheet members is maintained when the circular or inner tube sheet member is moved downwardly or upwardly the thermal expansion of the tubes such as the tubes 26 and 27 and the circular portion 32*a*. In the event that it is desired to have a heat exchange device wherein lower viscosity liquids are employed, the arrangement as depicted in FIGS. 2 and 4 may be employed wherein the interface such as the interfaces 62*c* and 82*c* provides sufficient clearance to permit movement of the outer annular portions without causing locking on the frustoconical interface 62*c* and 82*c*, hence a C-ring such as the C-ring 67 or 83 is relied upon for the primary seal. In the event that uniform temperature is achieved in the outer heat exchange member and the outer annular portion of the tube sheet, the embodiments of FIGS. 1 and 3 are satisfactorily employed as the original clearance is maintained as the tube sheets portions such as annular portions 62*b*, 72*b* and 82*b* move upwardly or downwardly, as ilustrated in FIGS. 2, 3 and 4 respectively, relative to circular portions 62*a*, 72*a* and 82*a*. The particular sealing arrangement employed at the interface such as the interfaces 32*c*, 62*c*, 72*c* and 82*c* generally are of a material of compromise depending upon the particular application for which the heat exchange vessel is being designed. A lapped interface such as the interface 72*c* for many applications is highly desirable wherein clearances may be maintained at a minimal value sufficient to prevent flow, or at least significant flow, from one surface of the floating tube sheet to the opposing surface of the floating tube sheet. However, for many applications it is unnecessary to lap the interface and an appropriate clearance between the floating tube sheet portions may be maintained and suitable sealing elements such as C rings, O rings, chevron packing and the like may be utilized to prevent flow from one surface to the opposing surface of the floating tube sheet.

Beneficially, flat plate heat exchangers in accordance with the present invention can be constructed with obvious boiler-making procedures of machining and welding. However, with regard to the heat exchange fluid conduits, such as conduits 24, 25, 26 and 27 of FIG. 1, it is frequently desirable to assemble all of the heat exchange elements and/or spaces and hydraulically expand the tubes. Very satisfactory metal-to-metal contact is obtained.

Employing heat exchange vessels in accordance with the present invention permits the use of a wide variety of different profiles and the material being processed in such vessels provides a highly desirable degree of control of the reaction mixture.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. In a heat exchange vessel, the vessel comprising an axis extending from a first end to a second end, a foraminous feed tube disposed generally coaxially with the axis of the vessel at least adjacent the first end, a first annular flat plate heat exchanger disposed coaxially about the foraminous tube; at least a second flat plate heat exchanger disposed externally to the first flat plate heat exchanger and generally coaxial therewith; means to supply a first heat exchange fluid to the first flat plate heat exchanger; means to supply a second heat exchange fluid to the second flat plate heat exchanger, the first and second flat plate heat exchangers being disposed within the vessel, the vessel having a product discharge port at the second end of the vessel with the further limitation that each of the flat plate heat exchangers comprise a plurality of generally annular flat plates, each having a centrally disposed aperture; the flat plate-like member assembled perpendicularly to the axis of the vessel with a space between each of the individual plate members; the plate members being positioned in close proximity to one another to provide a flow pattern between adjacent members, the plate members being in spaced apart relationship; a plurality of heat exchange conduits passing through said plate-like members to thereby permit circulation of heat exchange fluid through said conduits, wherein each of the flat plate heat exchangers has a common fixed tube sheet and a common floating tube sheet supported primarily by tubes passing through the flat plate heat exchanger, the improvement which comprises providing a floating tube sheet, the floating tube sheet comprising a first generally annular outer portion, a second generally discoidal inner portion, a frustoconical interface between the first and second floating tube sheet portions, the frustoconical interface being projectible to a cone having an apex which lies approximately at the intersection of a face of the fixed tube sheet which is adjacent a floating tube sheet and the intersection of said plane with the axis of generation of the flat plate heat exchangers.

2. The vessel of claim 1 wherein the frustoconical interface between the floating tube sheets is sealed by means of a C ring.

3. The vessel of claim 1 wherein the frustoconical interface between the floating tube sheets is sealed by means of an O ring.

4. The vessel of claim 1 wherein said frustoconical interface is lapped.

* * * * *